United States Patent [19]

Clegg

[11] 4,007,553

[45] Feb. 15, 1977

[54] SAFETY INDICATORS FOR GUNS

[76] Inventor: Kessler Q. Clegg, 904 Perkinswood SE., Warren, Ohio 44484

[22] Filed: Aug. 4, 1975

[21] Appl. No.: 601,380

[52] U.S. Cl. ..... 42/1 A; 33/241; 240/2 F

[51] Int. Cl.[2] ..... F41C 17/00; F41C 11/04

[58] Field of Search ..... 250/227; 240/2 F, 6.41, 240/1 LP; 42/1 A, 84, 70 C, 41; 33/241

[56] References Cited

UNITED STATES PATENTS

| | | | |
|---|---|---|---|
| 666,405 | 1/1901 | Baggett | 42/1 A |
| 1,029,951 | 6/1912 | Seely | 42/1 A |
| 1,900,184 | 3/1933 | Loomis | 42/41 |
| 2,134,406 | 10/1938 | Jacobs | 42/1 A |
| 2,461,241 | 2/1949 | Shann | 250/227 X |
| 3,044,204 | 7/1962 | Zimmerman | 42/1 A X |
| 3,573,868 | 4/1971 | Giannetti | 42/1 A |
| 3,718,814 | 2/1973 | Van Slyke | 240/1 LP |
| 3,747,251 | 7/1973 | Baker | 42/1 A |
| 3,842,526 | 10/1974 | Dixon | 42/1 A |

*Primary Examiner*—Harold Tudor
*Attorney, Agent, or Firm*—Michael Williams

[57] ABSTRACT

A safety indicator for guns, and particularly shot guns and rifles, utilizing a movable slide member which sets or releases the safety mechanism of the gun. A pair of jewels, in the form of glass or plastic crystals, are mounted in the gun stock to be selectively covered and uncovered when the slide member is moved to one or the other of its two positions, one jewel preferably being red and exposed when the slide member is moved to unlock the trigger.

The invention utilizes fiber optic rods to transmit light from an electric bulb which is energized when the safety slide member is moved to trigger unlocking position. Fiber optic rods are also utilized to transmit daylight to both of the jewels.

4 Claims, 6 Drawing Figures

SAFETY INDICATORS FOR GUNS

BACKGROUND AND SUMMARY

The prior art contains many patents relating to safety warning systems for firearms. The earlier patents disclose buzzer systems to indicate when the gun safety was in "off" position, but these systems were not readily acceptable because their noise tended to scare away or alert the game.

Later patents employed flashing or steadily illuminated lights to provide a warning that the gun safety was in off position, but these patented constructions were complicated and unreliable, and therefore not readily accepted.

My invention provides a warning system which is reliable in operation and may be readily incorporated in the stock of a gun, preferably a rifle or shotgun. The invention incorporates a cradle, formed of insulating material, which houses a cadmium battery, a light bulb and socket therefor, and a fiber optic rod to transmit light from the bulb to that jewel which is uncovered when the gun safety is moved to trigger-unlocking position. In addition, fiber optic rods are disposed to transmit daylight, or artificial light, to both jewels.

DESCRIPTION OF THE DRAWINGS

In the drawings accompanying this specification and forming a part of this application, there is shown, for purposes of illustration, an embodiment which my invention may assume, and in these drawings.

DESCRIPTION OF THE PREFERRED EMBODIMENT

Figure 1:
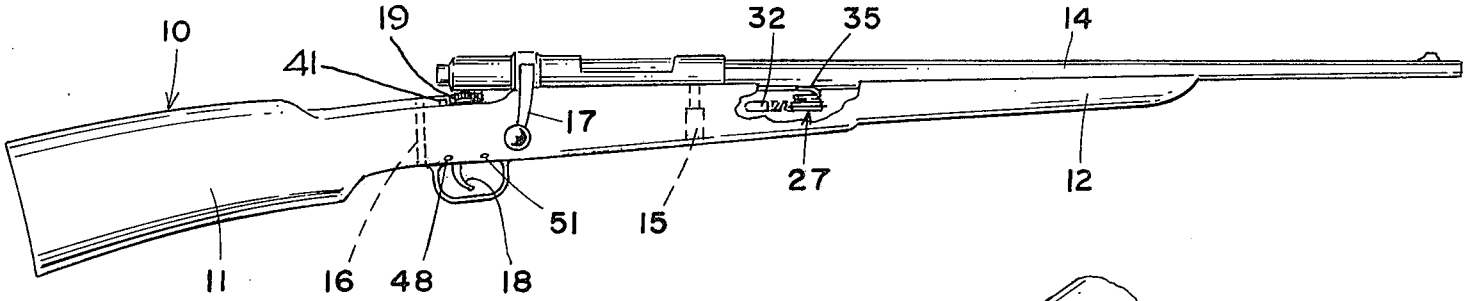
FIG. 1 is a small scale, side view of a rifle, incorporating my invention.

My invention is herein disclosed in combination with a rifle or shotgun, although it will be appreciated that it may be used in combination with other types of guns. The rifle shown in FIG. 1 comprises a gun stock 10 generally made of wood, and having a butt portion 11 and a forward barrel-receiving portion 12. The gun barrel 14 and attendant hardware is connected to the stock by forward and rearward recoil lugs 15 and 16, respectively, which fit into holes in the gun stock and are held in place by screws, in conventional manner.

Figure 2:
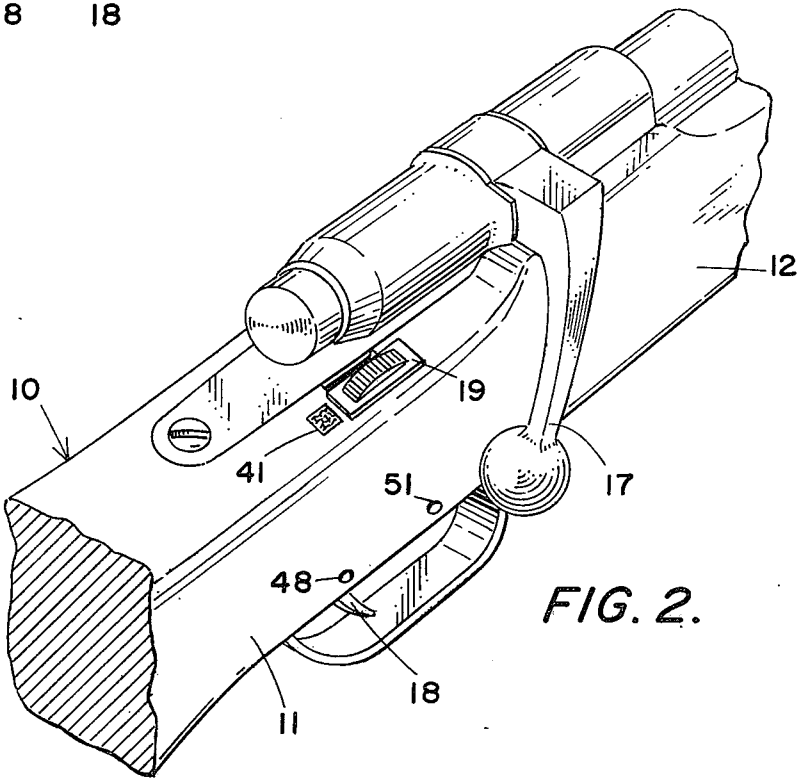
FIG. 2 is an enlarged, fragmentary, perspective view of the rifle.
Figure 4:
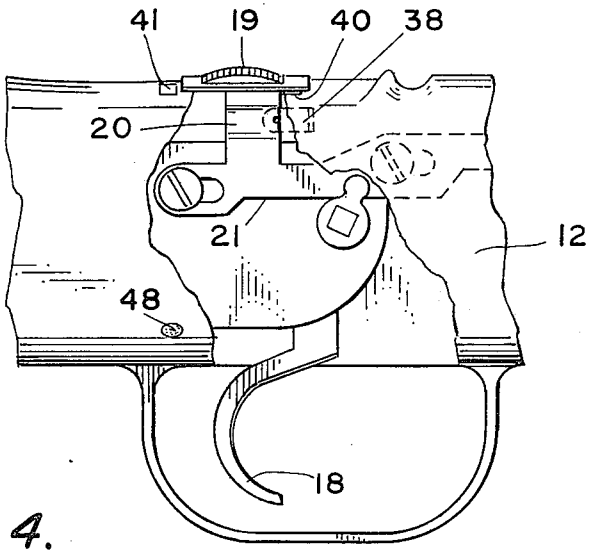
FIGS. 3 and 4 are fragmentary views of a safety mechanism with which my invention may be employed.
Figure 3:
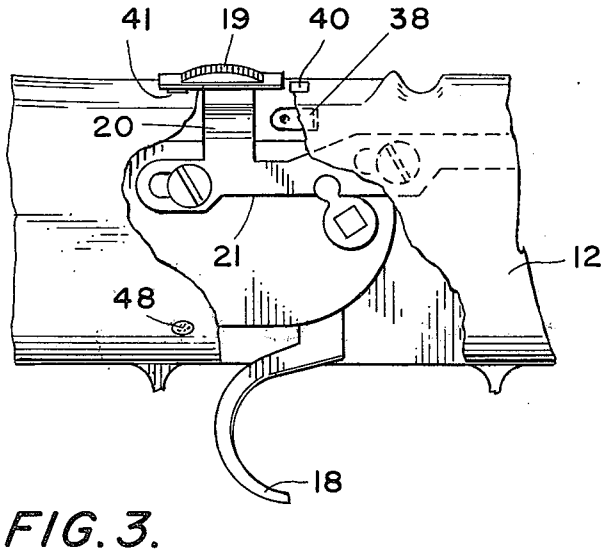

In FIG. 2, the usual bolt 17 and trigger 18 are shown. A slide member 19 is mounted on the stock for limited movement manually in a direction longitudinally of the stock. Rigidly connected to and depending from the slide member 19 is a shank 20 which, as seen in FIGS. 3 and 4, is adapted to operate the safety mechanism 21 of conventional construction to lock or unlock the trigger 18.

Figure 5:
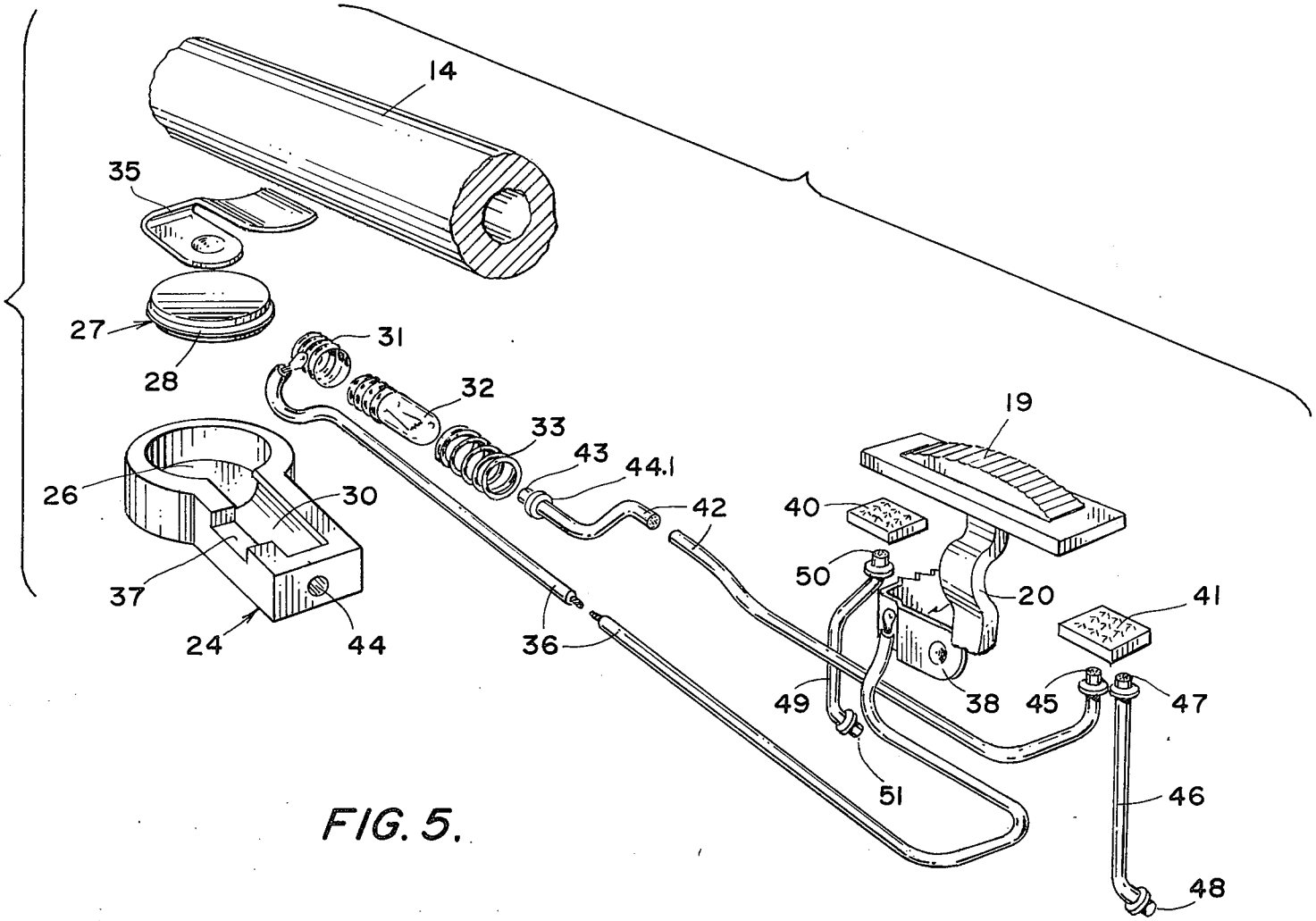
FIG. 5 is an enlarged, fragmentary perspective view of components of my invention, shown in separated relation.
Figure 6:
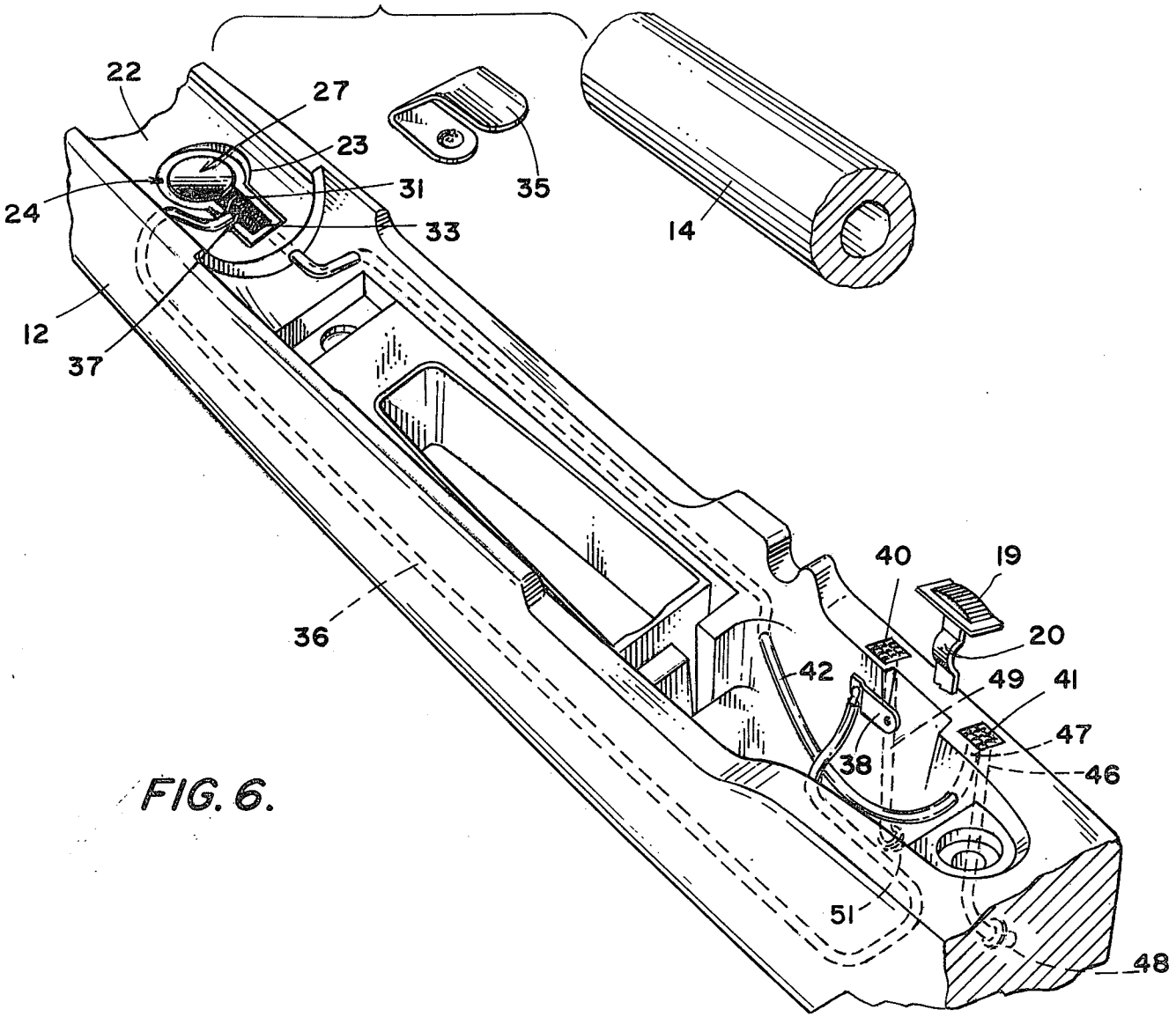
FIG. 6 is an enlarged, fragmentary perspective view, showing said components in relation with the barrel and stock of a rifle.

As seen in FIG. 6, the stock portion has a rounded, elongated recess 22 to receive the cylindrical portion of the gun barrel. A socket 23 extends transversely of the stock portion and is shaped to closely receive a keyhole shaped cradle 24 which is formed of suitable electrical insulating material, such as foam rubber or a suitable plastic. As suggested in FIG. 1, I prefer to form the socket 23 so that it is positioned in advance of the forward recoil lug 15. The cradle is formed with a circular recess 26, (FIG. 5) to closely receive a flat, circular cadmium battery 27. As seen in FIG. 5, the opposite sides of the battery are flat and they constitute the negative side of the battery. A peripheral ridge 28 is disposed midway of the opposite sides of the battery and constitutes the positive side of the battery.

The cradle 24 also has a longitudinal recess 30 to receive a metallic bulb socket 31, a light bulb 32 screwed into the socket, and a coil spring 33. As seen in FIG. 6, the spring 33 is adapted to press against the socket 31 to push it, and the light bulb 32 in a direction toward the battery. The base of the light bulb has the usual contact (not shown) which extends outwardly of the socket, and is adapted to bear against the battery peripheral ridge 28 to provide one contact for the bulb.

The longitudinal recess 30 is deep enough so that the socket 31, bulb 32, and spring 33 do not engage the metallic gun barrel 14. A spring clip 35 is adapted to be interposed between the gun barrel 14 and the upper side of the battery 27, as suggested in FIG. 5, to electrically connect the same. An insulated wire 36 has one end electrically connected to a side of the socket 31 and the cradle may be formed with a slot 37 to pass the adjacent portion of the wire to permit limited longitudinal movement of the socket. The wire 36 passes through a longitudinal recess or slot in the gun stock and has its opposite end electrically connected to a metal clip 38 which is supported by the gun stock 10 so that in the safety-off position of the slide member 19, the shank 20 of the latter engages the clip. Since the shank 20 forms part of the trigger latching mechanism, as seen in FIGS. 3 and 4, it is in electrical continuity with the metal hardware associated with the barrel 14. Therefore, when the shank 20 engages the clip 38, an electrical circuit is completed from the upper side of the battery 27, through the metal clip 35, the metal gun barrel 14, the shank 20, the metal clip 38, the wire 36, the metal socket 31, the end terminal of the bulb and to the peripheral ridge 28 of the battery, and the bulb will be energized.

Mounted on the stock 10, in line with the sliding movement of the slide member 19, are two jewels 40 and 41, arranged so that one is covered by the member 19 and the other is uncovered, in either position of the member. The jewel 40 may be clear while the jewel 41 may be red. When the slide member 19 is in position wherein the jewel 41 is uncovered, the gun safety is in off position to permit firing of the gun, and the red jewel will indicate that care must be observed in handling of the gun. As best seen in FIG. 2, the jewels are disposed closely adjacent to the bolt 17 and therefore will be readily observable.

Although the slide member 19 and bulb 32 are spaced some distance apart and the bulb is not in alignment with the jewel 41, my invention makes it possible to transmit light from the bulb to the jewel. As best seen in FIG. 5, a fiber optic rod 42, of well known construction, is utilized to transmit light from the bulb, and it will be noted that the rod has several bends to clear operating parts of the gun. One end 43 of the rod is adapted to project through a hole 44 in an end wall of the cradle 24 and through the spring 33, so that its terminal extremity is closely adjacent to the bulb. A collar 44.1 on the rod limits the amount of insertion of the rod so there is no danger of breaking the bulb.

The fiber optic rod may extend through connected bores in the gun stock 10, or may extend through an elongated slot therein, which slot is covered by a removable plate. Since this is of no great importance to my invention, the details of disposition of the fiber optic rod within the stock are not shown. The opposite end 45 of the fiber optic rod extends through the gun stock for disposition closely adjacent to the red jewel 41. The fiber optic rod 42 has the characteristic of transmitting light along its longitudinal extent, so that when the bulb 31 is energized, light therefrom will enter the terminal extremity adjacent to the bulb and will exit from the terminal extremity adjacent to the jewel 41 to cause the latter to glow very brightly and clearly exhibit a warning that the gun safety is off and that care should be observed in handling the gun.

Cadmium batteries of modern construction last a long time. However, as a precaution against battery failure, or failure of any other part of the illuminating circuitry, I provide an additional fiber optic rod 46 for cooperation with the red jewel 41. This rod has one terminal end 47 closely adjacent to the jewel 41 and its opposite terminal end 48 exposed at a side surface of the gun stock, as best seen in FIG. 2. Daylight, or available artificial light, is transmitted through the fiber optic rod 46 to cause the jewel 41 to glow. I also prefer to utilize a further fiber optic rod 49 having one terminal end 50 closely adjacent to the clear jewel 40 and its opposite terminal end 51 exposed at one side surface of the gun stock, as seen in FIG. 2.

From the foregoing, it will be clear that when the slide member 19 is moved to position to remove the gun safety, that is to place the gun in condition for firing, the red jewel 41 will be exposed and the clear jewel will be covered. In this position of the slide button, the shank 20 will engage the clip 38 to complete the electrical circuit through the bulb 32 and energize the same. Light from the bulb will be transmitted through the fiber optic rod 42 to cause the red jewel to glow, thus indicating danger. When the slide member is moved to position to set the gun safety, the red jewel 41 will be covered and the clear jewel will be uncovered. At the same time, the electrical circuit through the bulb 32 will be broken.

I claim:

1. A safety indicator device for a gun having a barrel, a stock and a safety mechanism for selectively setting the gun in a first condition for firing or in a second condition to prevent firing, said safety mechanism including a slide member mounted on said gun for movement between first and second positions corresponding respectively to said first and second conditions, said indicator device comprising a first jewel mounted on said gun adjacent said slide member and exposed by said slide member in said first position and covered thereby in said second position, a battery, light bulb and electrical circuit therebetween mounted in said gun, and including switch means cooperatively associated with said slide member for closing said circuit to energize said bulb when said slide member is in said first position, and opening said circuit in said second position, a first light-transmitting conduit means mounted on said gun extending between said light bulb and said jewel thereby to internally illuminate said jewel when said slide member is in said first position, and, second light-transmitting conduit means mounted in said gun to extend from said jewel to a point on the exterior thereof thereby to pick up ambient light to illuminate said jewel in the event of electrical failure with concomitant absence of positive light bulb illumination.

2. The safety indicator of claim 1 wherein said first and second light-transmitting means comprise fiber optic rods.

3. The safety indicator of claim 1 further including a second jewel mounted on said gun adjacent said slide member and exposed thereby when said slide member is in said second position and covered thereby in said first position, and further light-transmitting means extending between said second jewel to an exterior point on said gun, thereby to internally illuminate said jewel with ambient light.

4. The safety indicator of claim 3 wherein said first jewel is red to serve as a warning for said first condition and said second jewel is clear to indicate said second condition.

* * * * *